US006468957B1

(12) United States Patent
Larson et al.

(10) Patent No.: US 6,468,957 B1
(45) Date of Patent: Oct. 22, 2002

(54) GRANULATION METHOD

(75) Inventors: Bernd Larson, Erkelenz (DE); Josef Markiefka, Duesseldorf (DE); Wilfried Raehse, Duesseldorf (DE); Wieland Schulze, Langenfeld (DE); Matthias Sunder, Duesseldorf (DE)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 09/806,285

(22) PCT Filed: Sep. 18, 1999

(86) PCT No.: PCT/EP99/06920

§ 371 (c)(1),
(2), (4) Date: Mar. 28, 2001

(87) PCT Pub. No.: WO00/18872

PCT Pub. Date: Apr. 6, 2000

(30) Foreign Application Priority Data

Sep. 29, 1998 (DE) ..... 198 44 523

(51) Int. Cl.[7] ..... C11D 11/00; C11D 11/04

(52) U.S. Cl. ..... 510/444; 510/351; 510/353; 510/357; 510/491; 510/495; 510/498; 510/535; 562/97

(58) Field of Search ..... 510/444, 351, 510/353, 357, 491, 495, 498, 535; 562/97

(56) References Cited

U.S. PATENT DOCUMENTS

| | | | | |
|---|---|---|---|---|
| 4,664,839 A | | 5/1987 | Rieck | 252/175 |
| 4,820,439 A | | 4/1989 | Rieck | 252/135 |
| 4,919,847 A | * | 4/1990 | Barletta et al. | 510/442 |
| 5,189,207 A | * | 2/1993 | Blasey et al. | 562/97 |
| 5,356,607 A | | 10/1994 | Just | 423/334 |
| 5,616,550 A | | 4/1997 | Kruse et al. | 510/444 |
| 5,739,097 A | | 4/1998 | Bauer et al. | 510/446 |
| 5,780,420 A | | 7/1998 | Breuer et al. | 510/466 |

FOREIGN PATENT DOCUMENTS

| | | |
|---|---|---|
| DE | 39 14 131 | 4/1989 |
| DE | 42 32 874 | 3/1994 |
| DE | 43 04 062 | 8/1994 |
| DE | 44 00 024 | 7/1995 |
| DE | 44 25 968 | 2/1996 |
| EP | 0 164 514 | 6/1989 |
| EP | 0 265 203 | 4/1991 |
| EP | 0 211 493 | 7/1991 |
| EP | 0 438 320 | 7/1991 |
| EP | 0 642 576 | 7/1996 |
| EP | 0 402 112 | 8/1996 |
| EP | 0 555 622 | 7/1997 |
| EP | 0 508 543 | 8/1997 |
| EP | 0 772 674 | 6/1998 |
| EP | 0 507 402 | 2/1999 |
| EP | 0 678 573 | 11/2000 |
| JP | 58/217598 | 12/1983 |
| JP | 9241698 | 9/1997 |
| WO | WO 90/13533 | 11/1990 |
| WO | WO 91/08171 | 6/1991 |
| WO | WO 95/07331 | 3/1995 |
| WO | WO 98/20104 | 5/1998 |
| ZA | 6702422 | * 10/1968 |

OTHER PUBLICATIONS

De Groot, et al., "The Manufacture of Modern Detergent Powders", pp. 102–142, Hermann de Groot Academic Publisher, Wassenaar, 1995.

* cited by examiner

*Primary Examiner*—Lorina M. Douyon
(74) *Attorney, Agent, or Firm*—Stephen D. Harper; Glenn E. J. Murphy

(57) ABSTRACT

The invention relates to a neutralization and granulation method wherein a neutralizing foam is used as granulation adjuvant. The neutralizing foam was previously obtained by mixing an anionic surfactant in its acid form, which was expanded using a gaseous medium, and a highly concentrated, aqueous alkaline component, which was expanded using a gaseous medium. The neutralizing foam has an average pore size of less than 10 mm, preferably less than 5 mm and especially less than 2 mm.

51 Claims, No Drawings

GRANULATION METHOD

CROSS-REFERENCE TO RELATED APPLICATIONS

This application is a U.S. National Stage application filed under 35 U.S.C. §371, claiming benefit under 35 U.S.C. §365 of PCT/EP99/06920, filed in the European Patent Office Sep. 18, 1999, and under 35 U.S.C. §119 of DE 198 44 523.7, filed in the German Patent Office on Sep. 29, 1998.

BACKGROUND OF THE INVENTION

This invention relates to a process for the production of detergents. More particularly, the invention relates to a process by which it is possible to produce detergent compositions with or without a reduced number of spray drying steps.

Granular detergent compositions are largely produced by spray drying. In the spray drying process, the ingredients, such as surfactants, builders etc. containing around 35 to 50% by weight of water, are mixed to form an aqueous suspension, known as a slurry, and the resulting mixture is sprayed into a hot gas stream in spray drying towers, resulting in the formation of the detergent particles. Both the installations for this process and the operation of the process are expensive because most of the water in the slurry has to be evaporated in order to obtain particles having residual water contents of around 5 to 10% by weight. In addition, although the granules produced by spray drying generally show excellent solubility, they have low bulk densities which leads to higher packaging volumes and transportation and storage capacities. The flowability of spray-dried granules is also far from optimal in view of their irregular surface structure which also has an effect on their appearance. Spray drying processes have a number of other disadvantages, so that there has been no shortage of attempts to carry out the production of detergents without any spray drying whatever or at least to have low levels of spray-dried products in the end product.

Thus, W. Hermann de Groot, I. Adami, G. F. Moretti in "The Manufacture of Modern Detergent Powders", Hermann de Groot Academic Publisher, Wassenaar, 1995, pages 102 et seq. describe various mixing and granulation processes for the production of detergents. One feature common to all these processes is that premixed solids are granulated in the presence of the liquid ingredients and optionally dried in a following step.

A broad prior art on the non-tower production of detergents also exists in the patent literature. Many of these processes start out from the acid form of anionic surfactants because, in quantitative terms, this class of surfactants represents the largest percentage of detersive substances and because, in the course of their production, anionic surfactants accumulate in the form of the free acids which have to be neutralized to the corresponding salts.

Thus, European patent application EP-A-0 678 573 (Procter & Gamble) describes a process for the production of flowable surfactant granules having bulk densities above 600 g/l, in which anionic surfactant acids are reacted with an excess of neutralizing agent to form a paste containing at least 40% by weight of surfactant and the resulting paste is mixed with one or more powder(s), of which at least one has to be spray-dried and contains anionic polymer and cationic surfactant, the resulting granules optionally being dried. Although this document reduces the percentage of spray-dried granules in the detergents, it does not avoid spray drying altogether.

European patent application EP-A-0 438 320 (Unilever) discloses a batch process for the production of surfactant granules having bulk densities above 650 g/l. In this process, the anionic surfactant acid is added, optionally with other solids, to a solution of an alkaline inorganic substance in water and the whole is granulated with a liquid binder in a high-speed mixer/granulator. Although neutralization and granulation take place in the same apparatus, they are carried out in separate process steps so that the process can only be operated in batches.

European patent application EP-A-0 402 112 (Procter & Gamble) describes a continuous neutralization/granulation process for the production of FAS and/or ABS granules from the acid, in which the ABS acid is neutralized with at least 62% NaOH and is then granulated in the presence of auxiliaries, for example ethoxylated alcohols or alkyl phenols or a polyethylene glycol with a molecular weight of 4,000 to 50,000 melting at temperatures above 48.9° C.

European patent application EP-A-0 508 543 (Procter & Gamble) discloses a process in which a surfactant acid is neutralized with an excess of alkali to form an at least 40% by weight surfactant paste which is subsequently conditioned and granulated, the granules being directly cooled with dry ice or liquid nitrogen.

Dry neutralization processes, in which sulfonic acids are neutralized and granulated, are disclosed in EP 555 622 (Procter & Gamble). According to the teaching of this document, the anionic surfactant acids are neutralized in a high-speed mixer with an excess of fine-particle neutralizing agent having a mean particle size below 5 $\mu$m.

A similar process, which is also carried out in a high-speed mixer and in which sodium carbonate ground to between 2 and 20 $\mu$m in size is used as the neutralizing agent, is described in WO 98/20104 (Procter & Gamble).

Surfactant mixtures which are subsequently sprayed onto solid absorbents and which provide detergent compositions or complonents therefor are also described in EP 265 203 (Unilever). The liquid surfactant mixtures disclosed in this document contain sodium or potassium salts of alkyl benzenesulfonic acids or alkyl sulfuric acids in quantities of up to 80% by weight, ethoxylated nonionic surfactants in quantities of up to 80% by weight and at most 10% by weight water.

Similar surfactant mixtures are also described in earlier EP 211 493 (Unilever). According to the teaching of this document, the surfactant mixtures to be sprayed on contain between 40 and 92% by weight of a surfactant mixture and more than 8 to at most 60% by weight of water. At least 50% of the surfactant mixture itself consists of polyalkoxylated nonionic surfactants and ionic surfactants.

A process for the production of a liquid surfactant mixture of the three components anionic surfactant, nonionic surfactant and water is described in EP 507 402 (Unilever). The surfactant mixtures disclosed in this document, which are said to contain very little water, are obtained by combining equimolar quantities of neutralizing agent and anionic surfactant acid in the presence of nonionic surfactant.

DE-A-42 32 874 (Henkel KGaA) discloses a process for the production of detersive anionic surfactant granules by neutralizing anionic surfactants in their acid form. However, only solid powders are disclosed as the neutralizing agents. The granules obtained have surfactant contents of around 30% by weight and bulk densities below 550 g/l.

EP-A-642 576 (Henkel KGaA) describes a two-step granulation process carried out in two mixer/granulators arranged in tandem, 40 to 100% by weight, based on the total quantity of constituents used, of the solid and liquid constituents being pregranulated in a first low-speed granulator and the "pregranules" being mixed with the remaining constituents, if any, and converted into granules in a second high-speed granulator.

EP 772 674 (Henkel KGaA) describes a process for the production of surfactant granules by spray drying in which anionic surfactant acid(s) and highly concentrated alkaline solutions are separately exposed to a gaseous medium and mixed in a multicomponent nozzle, neutralized and spray-dried by spraying into a hot gas stream. The fine-particle surfactant particles thus obtained are then agglomerated in a mixer to form granules with bulk densities above 400 g/l.

Now, the problem addressed by the present invention was to provide a process by which it would be possible to produce detergents with or without a reduced number of spray drying steps. The process to be provided by the invention would also enable the acid forms of detergent raw materials to be processed in a direct and economically attractive manner, but would avoid the disadvantage of the energy-intensive evaporation of water as far as possible. Theoretical solutions to the described problems are described in the prior-art literature cited in the foregoing. Nevertheless, the processes in question are attended by a number of disadvantages:

- the neutralization with NaOH, as described in the prior art, generates a considerable amount of heat, overheating leading to the unwanted darkening of the products in color;
- direct cooling with dry ice or liquid nitrogen incurs high operating costs;
- cooling by indirect heat transfer requires a slow or even batch reaction with long holding times and large reactor volumes which requires high capital investment costs;
- in the case of indirect cooling, the viscosity of the neutralization mixture often increases dramatically, so that water has to be added which in turn entails subsequent drying;
- high concentrations of active substances generally increase the viscosity, with the result that the neutralizate is difficult to incorporate uniformly during subsequent agglomeration steps on solid carriers;
- where solid neutralizing and agglomerating agents (for example sodium carbonate) are used, the neutralization reaction either proceeds slowly and/or is initially incomplete, so that acid-sensitive solids, such as silicates or zeolites, should not be present in the solid bed.

Avoiding the above-mentioned disadvantages and providing a process which would enable anionic surfactant acids to be quickly and completely neutralized without the danger of overheating and which would include particularly easy further processing to surfactant-containing granules were further objects of the present invention.

DESCRIPTION OF THE INVENTION

The problem stated above is solved by a mixing and granulation process in which anionic surfactant acid(s) and alkali solutions are combined to form a neutralizate foam which acts as a granulation aid. Accordingly, the present invention relates to a process for the production of surfactant granules in which an anionic surfactant in its acid form and a highly concentrated aqueous alkaline component are separately exposed to a gaseous medium, subsequently combined and then neutralized and both the anionic surfactant in its acid form and the highly concentrated aqueous alkaline component are foamed by the gaseous medium and the acidic and alkaline foams formed are combined to form a neutralizate foam which is subsequently applied to a bed of solids accommodated in a mixer.

The term "foam" used in the present specification characterizes structures of gas-filled, spherical or polyhedral cells (pores) which are defined by liquid, semiliquid or highly viscous cell walls.

If the concentration by volume of the gas forming the foam is less than 74% for homodisperse distribution, the gas bubbles are spherical on account of the surface-reducing effect of the interfacial tension. Beyond the close packing limit, the bubbles are deformed to polyhedral lamellae which are defined by ca. 4–600 nm thin skins. The cell walls—joined via by so-called nodal points—form a coherent structure. The foam lamellae extend between the cell walls (closed-cell foam). If the foam lamellae are destroyed or if they flow back into the cell walls at the end of foaming, an open-cell foam is obtained. Foams are thermodynamically unstable because surface energy can be obtained by making the surface smaller. Accordingly, the stability and hence the existence of the foams according to the invention depends on the extent to which it is possible to prevent their self-destruction.

To produce the foams, the gaseous medium may be injected into the above-mentioned liquids. Alternatively, foaming can be achieved by intensive beating, shaking, spraying or stirring of the liquid in the particular gas atmosphere. Because it provides for easier foaming and can be better controlled and carried out, foam generation by injection of the gaseous medium ("mechanical blowing") is distinctly preferred to the other variants for the purposes of the present invention. Depending on the required process variant, mechanical blowing takes place continuously or discontinuously via perforated plates, sintered disks, sieve insets, Venturi nozzles, inline mixers, homogenizers or other standard systems.

Any gases or gas mixtures may be used as the gaseous medium for foaming. Examples of gases used in the art are nitrogen, oxygen, noble gases and noble gas mixtures, for example helium, neon, argon and mixtures thereof, carbon dioxide, etc. For reasons of cost, the process according to the invention is preferably carried out with air as the gaseous medium. Providing the components to be foamed are oxidation-resistant, the gaseous medium may even consist entirely or partly of ozone so that impurities or discoloration destroyable by oxidation in the surfactant-containing liquid components to be foamed can be eliminated or germ infestation of those components can be prevented.

The process according to the invention comprises the independent steps of producing foams from an anionic surfactant in its acid form and from a highly concentrated, aqueous alkaline component. The two foams are then combined to form a neutralizate foam which subsequently serves as a granulation aid when added to a bed of solids accommodated in a mixer. The ingredients of the intermediate products of the first two steps are described hereinafter.

One or more representatives from the group of carboxylic acids, sulfuric acid semiesters and sulfonic acids, preferably from the group of fatty acids, fatty alkyl sulfuric acids and alkylaryl sulfonic acids, is/are preferably used as the anionic surfactants in acid form. In order to obtain adequate surface-active properties, the compounds mentioned should have relatively long hydrocarbon chains, i.e. should contain at least 6 carbon atoms in the alkyl or alkenyl group. The C-chain distributions of the anionic surfactants are normally in the range from 6 to 40, preferably in the range from 8 to 30 and more preferably in the range from 12 to 22 carbon atoms.

On an industrial scale, carboxylic acids—which are used in the form of their alkali metal salts as soaps in detergents—are largely obtained from native fats and oils by hydrolysis. Whereas alkaline saponification, which was practised as long ago as the last century, led directly to the alkali metal salts (soaps), only water is now industrially used for hydrolysis, splitting the fats into glycerol and the free fatty acids. Industrially used processes include, for example, hydrolysis in an autoclave and continuous high-pressure hydrolysis. According to the invention, carboxylic acids suitable for use as the anionic surfactants in acid form are, for example, hexanoic acid (caproic acid), heptanoic acid (oenanthic acid), octanoic acid (caprylic acid), nonanoic acid (pelargonic acid), decanoic acid (capric acid), undecanoic acid, etc. According to the invention, it is preferred to use fatty acids, such as dodecanoic acid (lauric acid), tetradecanoic acid (myristic acid), hexadecanoic acid (palmitic acid), octadecanoic acid (stearic acid), eicosanoic acid (arachic acid), docosanoic acid (behenic acid), tetracosanoic acid (lignoceric acid), hexacosanoic acid (cerotic acid), triacontanoic acid (melissic acid) and the unsaturated species 9c-hexadecenoic acid (palmitoleic acid), 6c-octadecenoic acid (petroselic acid), 6t-octadecenoic acid (petroselaidic acid), 9c-octadecenoic acid (oleic acid), 9t-octadecenoic acid (elaidic acid), 9c,12c-octadecadienoic acid (linoleic acid), 9t,12t-octadecadienoic acid (linolaidic acid) and 9c,12c,15c-octadecatrienoic acid (linolenic acid). For reasons of cost, technical mixtures of the individual acids obtainable from the hydrolysis of fats are used in preference to the pure species. Mixtures such as these are, for example, coconut oil fatty acid (ca. 6% by weight $C_8$, 6% by weight $C_{10}$, 48% by weight $C_{12}$, 18% by weight $C_{14}$, 10% by weight $C_{16}$, 2% by weight $C_{18}$, 8% by weight $C_{18'}$, 1% by weight $C_{18''}$), palm kernel oil fatty acid (ca. 4% by weight $C_8$, 5% by weight $C_{10}$, 50% by weight $C_{12}$, 15% by weight $C_{14}$, 7% by weight $C_{16}$, 2% by weight $C_{18}$, 15% by weight $C_{18'}$, 1% by weight $C_{18''}$), tallow fatty acid (ca. 3% by weight $C_{14}$, 26% by weight $C_{16}$, 2% by weight $C_{16'}$, 2% by weight $C_{17}$, 17% by weight $C_{18}$, 44% by weight $C_{18'}$, 3% by weight $C_{18''}$, 1% by weight $C_{18'''}$), hydrogenated tallow fatty acid (ca. 2% by weight $C_{14}$, 28% by weight $C_{16}$, 2% by weight $C_{17}$, 63% by weight $C_{18}$. 1% by weight $C_{18'}$), technical oleic acid (ca. 1% by weight $C_{12}$, 3% by weight $C_{14}$, 5% by weight $C_{16}$, 6% by weight $C_{16'}$, 1% by weight $C_{17}$, 2% by weight $C_{18}$, 70% by weight $C_{18'}$, 10% by weight $C_{18''}$, 0.5% by weight $C_{18'''}$), technical palmitic/stearic acid (ca. 1% by weight $C_{12}$, 2% by weight $C_{14}$, 45% by weight $C_{16}$, 2% by weight $C_{17}$, 47% by weight $C_{18}$. 1% by weight $C_{18'}$) and soybean oil fatty acid (ca. 2% by weight $C_{14}$, 15% by weight $C_{16}$, 5% by weight $C_{18}$, 25% by weight $C_{18'}$, 45% by weight $C_{18''}$, 7% by weight $C_{18'''}$).

Sulfuric acid semiesters of relatively long-chain alcohols are also anionic surfactants in their acid form and may be used in the process according to the invention. Their alkali metal salts, more especially sodium salts, the fatty alcohol sulfates, can be industrially obtained from fatty alcohols which are reacted with sulfuric acid, chlorosulfonic acid, amidosulfonic acid or sulfur trioxide to form the corresponding alkyl sulfuric acids and then neutralized. The fatty alcohols are obtained from the corresponding fatty acids or fatty acid mixtures by high-pressure hydrogenation of the fatty acid methyl esters. In quantitative terms, the most important industrial process for the production of fatty alkyl sulfuric acids is sulfonation of the alcohols with $SO_3$/air mixtures in special cascade, falling-film or tube-bundle reactors.

Another class of anionic surfactant acids which may be used in the process according to the invention are the alkyl ether sulfuric acids of which the salts, the alkyl ether sulfates, are distinguished from the alkyl sulfates by greater solubility in water and lower sensitivity to water hardness (solubility of the Ca salts). Like the alkyl sulfuric acids, alkyl ether sulfuric acids are synthesized from fatty alcohols which are reacted with ethylene oxide to form the corresponding fatty alcohol ethoxylates. Propylene oxide may be used instead of ethylene oxide. The subsequent sulfonation with gaseous sulfur trioxide in short-time sulfonation reactors gives yields of more than 98% of the corresponding alkyl ether sulfuric acids.

Alkane sulfonic acids and olefin sulfonic acids may also be used as anionic surfactants in acid form for the purposes of the present invention. Alkane sulfonic acids may contain the sulfonic acid group terminally bound (primary alkane sulfonic acids) or along the C-chain (secondary alkane sulfonic acids), only the secondary alkane sulfonic acids being of commercial importance. They are prepared by sulfochlorination or sulfoxidation of linear hydrocarbons. Where sulfochlorination is carried out by Reed's method, n-paraffins are reacted with sulfur dioxide and chlorine in the presence of UV light to form the corresponding sulfochlorides which directly give the alkane sulfonates on hydrolysis with alkalis and the alkane sulfonic acids on reaction with water. Since di- and polysulfochlorides and chlorinated hydrocarbons can occur as secondary products of the radical reaction in the sulfochlorination process, the reaction is normally continued to conversions of only 30% and then terminated.

Another process for the production of alkane sulfonic acids is sulfoxidation in which n-paraffins are reacted with sulfur dioxide and oxygen in the presence of UV light. Successive alkyl sulfonyl radicals are formed in this radical reaction and then react with oxygen to form the alkyl persulfonyl radicals. The reaction with unreacted paraffin produces an alkyl radical and the alkyl persulfonic acid which breaks down into an alkyl peroxysulfonyl radical and a hydroxyl radical. The reaction of the two radicals with unreacted paraffin gives the alkyl sulfonic acids and water which reacts with alkyl persulfonic acid and sulfur dioxide to form sulfuric acid. In order to keep the yield of the two end products, alkyl sulfonic acid and sulfuric acid, as high as possible and to suppress secondary reactions, this reaction is normally continued to conversions of only 1% and then terminated.

Olefin sulfonates are industrially produced by reaction of α-olefins with sulfur trioxide. Zwitterions are formed as intermediate products and cyclize to form so-called sultones. Under suitable conditions (alkaline or acidic hydrolysis), these sultones react to form hydroxyalkane sulfonic acids or alkene sulfonic acids which may both also be used as anionic surfactant acids.

Alkyl benzenesulfonates as high-performance anionic surfactants have been known since the nineteen thirties. At that time, alkyl benzenes were produced by monochlorination of Kogasin fractions and subsequent Friedel-Crafts alkylation, sulfonated with oleum and neutralized with sodium hydroxide. At the beginning of the fifties, alkyl benzenesulfonates were produced by tetramerizing propylene to form branched α-dodecylene and reacting the product in a Friedel-Crafts reaction using aluminium trichloride or hydrogen chloride to form tetrapropylene benzene which was then sulfonated and neutralized. This economic method of producing tetrapropylene benzene sulfonates (TPS) led to the breakthrough of this class of surfactants which subsequently displaced soaps as the main surfactant in detergents.

In view of the biological non-degradability of TPS, new alkyl benzenesulfonates distinguished by improved ecological behavior had to be produced. These requirements are satisfied by linear alkyl benzenesulfonates which, today, are virtually the only alkyl benzenesulfonates in production and which are referred to in short by the initials ABS.

Linear alkyl benzenesulfonates are prepared from linear alkyl benzenes which in turn can be obtained from linear olefins. To this end, petroleum fractions are separated using molecular sieves into the n-paraffins with the requisite purity and dehydrogenated to the n-olefins, both α- and i-olefins being obtained. The olefins thus obtained are then reacted with benzene in the presence of acidic catalysts to form the alkyl benzenes, the choice of the Friedel-Crafts catalyst having an influence on the isomer distribution of the linear alkyl benzenes formed. Where aluminium trichloride is used, the content of the 2-phenyl isomers in the mixture with the 3-, 4-, 5- and other isomers is approximately 30% by weight. If, by contrast, hydrogen fluoride is used as the catalyst, the 2-phenyl isomer content can be reduced to around 20% by weight. Finally, the sulfonation of the linear alkyl benzenes is now carried out on an industrial scale with oleum, sulfuric acid or gaseous sulfur trioxide, gaseous sulfur trioxide having by far the greatest importance. Special falling-film or tube-bundle reactors are used for the sulfonation process and give as the end product a 97% by weight alkyl benzenesulfonic acid (ABSA) which may be used as the anionic surfactant acid for the purposes of the present invention.

Various salts, i.e. alkyl benzene sulfonates, can be obtained from the ABSA, depending on the choice of the neutralizing agent. For reasons of economy, it is preferred to produce and use the alkali metal salts of ABSA, preferably the sodium salts. The sodium salts correspond to general formula I:

(I)

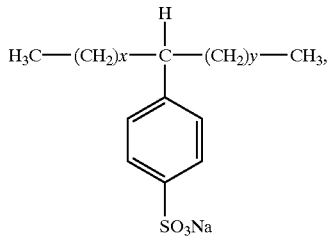

in which the sum of x and y is normally between 5 and 13. Processes according to the invention, in which $C_{8-16}$, preferably $C_{9-13}$ alkyl benzene-sulfonic acids are used as the anionic surfactant in acid form, are preferred. Another preferred embodiment of the present invention is characterized by the use of $C_{8-16}$, preferably $C_{9-13}$ alkyl benzenesulfonic acids derived from alkyl benzenes having a tetralin content of less than 5% by weight, based on the alkyl benzene. Another preferred embodiment is characterized by the use of alkyl benzenesulfonic acids of which the alkyl benzenes have been produced by the HF process, so that the $C_{8-16}$, preferably $C_{9-13}$ alkyl benzene sulfonic acids used have a 2-phenyl isomer content below 22% by weight, based on the alkyl benzenesulfonic acid.

The anionic surfactants in their acid form mentioned above may be used and foamed either individually or in the form of mixtures with one another in the process according to the invention. However, it is also possible and preferred to add other, preferably acidic, detergent ingredients in quantities of 0.1 to 40% by weight, preferably 1 to 15% by weight and more preferably 2 to 10% by weight, based on the weight of the mixture to be foamed, to the anionic surfactant in acid form before foaming.

Besides the "surfactant acids", the above-mentioned fatty acids, phosphonic acids, polymer acids or partly neutralized polymer acids and "builder acids" and "complex builder acids" (particulars given hereinafter), either individually or in the form of mixtures, are also suitable acidic reactants for the purposes of the invention. Suitable detergent ingredients, which may be added to the anionic surfactant acid before foaming, are above all acidic detergent ingredients, i.e. for example phosphonic acids which, in neutralized form (phosphonates), are present as incrustation inhibitors in many detergents. According to the invention, (partly neutralized) polymer acids, such as polyacrylic acids for example, may also be used. However, acid-stable ingredients may also be mixed with the anionic surfactant acid before foaming. Suitable ingredients of this type are, for example, so-called minor components which would otherwise have to be added in expensive additional steps, i.e. for example optical brighteners, dyes etc., acid stability having to be tested in each individual case.

Nonionic surfactants may optionally be added to the anionic surfactant in acid form before foaming in quantities of 0.1 to 40% by weight, preferably 1 to 15% by weight and more preferably 2 to 10% by weight, based on the weight of the mixture to be foamed. This addition can improve the physical properties of the anionic surfactant acid foam and can eliminate the need for nonionic surfactants to be subsequently incorporated in the surfactant granules or in the detergent as a whole. The various representatives from the group of nonionic surfactants are described further below.

Concentrated solutions of water-soluble alkalis in water may be used as the highly concentrated, aqueous alkaline components which are also foamed in a separate step. In principle, various alkalis, for example alkanolamines and metal hydroxies, may be used here, although alkali metal hydroxide solutions, preferably sodium hydroxide solutions with concentrations of at least 40% by weight NaOH, preferably at least 50% by weight NaOH and more preferably at least 65% by weight NaOH, based on the aqueous alkaline component to be foamed, are used as the aqueous alkaline component for practical and economic reasons.

The sodium hydroxide concentration of the solution may be increased providing the temperature of the solution is increased at the same time. According to the invention, this is not a problem.

Other ingredients of detergents may also be added to the aqueous alkaline component before foaming. In this case, these other detergent ingredients are added in quantities of preferably 0.1 to 80% by weight, more preferably 10 to 75% by weight and most preferably 25 to 70% by weight, based on the weight of the mixture to be foamed. Through the detergent ingredients to the alkaline component to be foamed, its viscosity can be increased and adapted to the viscosity of the anionic surfactant acid. So far as the subsequent mixing of the two foams produced in the separate steps is concerned, it can be of advantage if the two liquid components to be foamed (surfactant acid and alkali component) have similar and preferably even identical viscosities before foaming. The viscosities are measured in known manner using a Ford cup or spindle viscosimeters, such as the Brookfield viscosimeter. The viscosity of the alkaline component to be foamed may be adjusted with commercially available viscosity adjusters. Besides synthetic polymers, for example polyacrylates, polyurethanes, etc., natural or partly synthetic products such as, for example, xanthans, celluloses and cellulose derivatives, starch and starch derivatives, etc. may also be used. These organic high molecular weight substances or so-called swellng agents, which absorb liquids, swell in the process and finally change into viscous true or colloidal solutions, emanate from the groups of natural polymers, modified natural polymers and fully synthetic polymers. Naturally occurring polymers which may be used as thickeners are, for example, agar agar, carrageen, tragacanth, gum arabic, alginates, pectins, polyoses, guar gum, locust bean gum, starch, dextrins, gelatin and casein. Modified natural materials belong above all to the group of modified starches and celluloses, of which carboxymethyl cellulose and other cellulose ethers, hydroxyethyl cellulose and hydroxypropyl cellulose and also gum ethers are mentioned as examples. A large group of thickeners which are widely used in various fields of application are the fully synthetic polymers, such as polyacrylic and polymethacrylic compounds, vinyl polymers, polycarboxylic acids, polyethers, polyimines, polyamides and polyurethanes.

Thickeners from the classes of compounds mentioned are commercially obtainable and are marketed, for example, under the names of Acusol® 820 (methacrylic acid (stearyl alcohol-20 EO) ester/acrylic acid copolymer, 30% in water; Rohm & Haas), Dapral® GT 282 S (alkyl poly-glycol ether; Akzo), Deuterol® Polymer-11 (dicarboxylic acid copolymer; Schöner GmbH), Deuteron® XG (anionic heteropolysaccharide based on β-D-glucose, D-mannose, D-glucuronic acid; Schöner GmbH), Deuteron® XN (nonionic polysaccharide; Schöner GmbH), Dicrylan® Verdicker-O (ethylene oxide adduct, 50% in water/isopropanol; Pfersse Chemie), EMA® 81 and EMA® 91 (ethylene/maleic anhydride copolymer; Monsanto), Verdicker-QR-1001 (polyurethane emulsion, 19–21% in water/diglycol ether; Rohm & Haas), Mirox®-AM (anionic acrylic acid/acrylate copolymer dispersion, 25% in water; Stockhausen), SER-AD-FX-1100 (hydrophobic urethane polymer; Servo Delden), Shellflo® S (high molecular weight poly-saccharide, stabilized with formaldehyde; Shell) and Shellflo® XA (xanthan biopolymer, stabilized with formaldehyde; Shell).

A preferred polymeric thickener is xanthan, a microbial anionic heteropolysaccharide which is produced by Xanthomonas campestris and a few other species under aerobic conditions and which has a molecular weight of 2 to 15 million dalton. Xanthan consists of a chain with β-1,4-glucose (cellulose) with side chains. The structure of the sub-groups consists of glucose, mannose, glucuronic acid, acetate and pyruvate, the number of pyruvate units determining the viscosity of the xanthan. Xanthan may be described by the following formula:

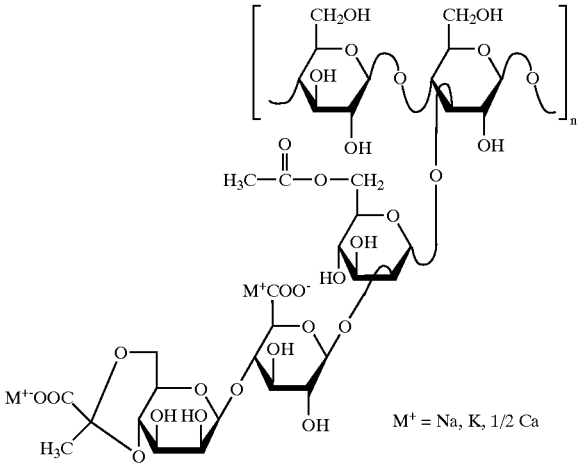

Basic Unit of Xanthan

Another viscosity adjuster which has been successfully used is carboxymethyl cellulose (CMC) with which it is even possible, for example, to foam sodium hydroxide in a sufficiently stable manner without using any other additives.

Although it is possible in principle to foam the aqueous alkaline component without any other additives and to combine the resulting foam with the anionic surfactant acid foam to form a neutralizate foam, it is preferred to add foam stabilizers to the aqueous alkali solution before foaming. In preferred processes, surfactants, more particularly anionic and/or nonionic surfactants, preferably ethoxylated alcohols and/or soaps, are added to and mixed with the aqueous alkaline component before foaming.

Preferred nonionic surfactants are alkoxylated, advantageously ethoxylated, more especially primary alcohols preferably containing 8 to 18 carbon atoms and, on average, 1 to 12 moles of ethylene oxide (EO) per mole of alcohol, in which the alcohol radical may be linear or, preferably, methyl-branched in the 2-position or may contain linear and methyl-branched radicals in the form of the mixtures typically present in oxoalcohol radicals. However, alcohol ethoxylates containing linear radicals of alcohols of native origin with 12 to 18 carbon atoms, for example coconut oil, palm oil, tallow fatty or oleyl alcohol, and on average 2 to 8 EO per mole of alcohol are particularly preferred. Preferred ethoxylated alcohols include, for example, $C_{12-14}$ alcohols containing 3 EO or 4 EO, $C_{9-11}$ alcohol containing 7 EO, $C_{13-15}$ alcohols containing 3 EO, 5 EO, 7 EO or 8 EO, $C_{12-18}$ alcohols containing 3 EO, 5 EO or 7 EO and mixtures thereof, such as mixtures of $C_{12-14}$ alcohol containing 3 EO and $C_{12-18}$ alcohol containing 5 EO. The degrees of ethoxylation mentioned represent statistical mean values which, for a special product, can be a whole number or a broken number. Preferred alcohol ethoxylates have a narrow homolog distribution (narrow range ethoxylates, NRE). In addition to these nonionic surfactants, fatty alcohols containing more than 12 EO may also be used, examples including tallow fatty alcohol containing 14 EO, 25 EO, 30 EO or 40 EO.

Another class of preferred nonionic surfactants which may be used either as sole nonionic surfactant or in combination with other nonionic surfactants are alkoxylated, preferably ethoxylated or ethoxylated and propoxylated, fatty acid alkyl esters preferably containing 1 to 4 carbon atoms in the alkyl chain, more especially the fatty acid methyl esters which are described, for example, in Japanese patent application JP 58/217598 or which are preferably produced by the process described in International patent application WO-A-90/13533.

Another class of nonionic surfactants which may be used with advantage are the alkyl polyglycosides (APGs). Suitable alkyl polyglycosides correspond to the general formula $RO(G)_z$ where R is a linear or branched, more particularly 2-methyl-branched, saturated or unsaturated aliphatic radical containing 8 to 22 and preferably 12 to 18 carbon atoms and G stands for a glycose unit containing 5 or 6 carbon atoms, preferably glucose. The degree of glycosidation z is between 1.0 and 4.0, preferably between 1.0 and 2.0 and more preferably between 1.1 and 1.4. Linear alkyl polyglucosides, i.e. alkyl polyglycosides in which the polyglycosyl moiety is a glucose unit and the alkyl moiety is an n-alkyl group, are preferably used.

The surfactant granules produced in accordance with the invention may preferably contain alkyl polyglycosides, APG contents in the granules of more than 0.2% by weight, based on the granules as a whole, being preferred. Particularly preferred surfactant granules contain APG in quantities of 0.2 to 10% by weight, preferably 0.2 to 5% by weight and more preferably 0.5 to 3% by weight.

Nonionic surfactants of the amine oxide type, for example N-cocoalkyl-N,N-dimethylamine oxide and N-tallowalkyl-N,N-dihydroxyethylamine oxide, and the fatty acid alkanolamide type are also suitable. The quantity in which these nonionic surfactants are used is preferably no more than the quantity in which the ethoxylated fatty alcohols are used and, more preferably, no more than half that quantity.

Other suitable surfactants are polyhydroxyfatty acid amides corresponding to formula (II):

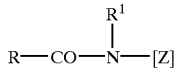

(II)

in which RCO is an aliphatic acyl group containing 6 to 22 carbon atoms, $R^1$ is hydrogen, an alkyl or hydroxyalkyl group containing 1 to 4 carbon atoms and [Z] is a linear or branched polyhydroxyalkyl group containing 3 to 10 carbon atoms and 3 to 10 hydroxyl groups. The polyhydroxyfatty acid amides are known substances which may normally be obtained by reductive amination of a reducing sugar with ammonia, an alkylamine or an alkanolamine and subsequent acylation with a fatty acid, a fatty acid alkyl ester or a fatty acid chloride.

The group of polyhydroxyfatty acid amides also includes compounds corresponding to formula (III):

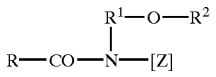

(III)

in which R is a linear or branched alkyl or alkenyl group containing 7 to 12 carbon atoms, $R^1$ is a linear, branched or cyclic alkyl group or an aryl group containing 2 to 8 carbon atoms and $R^2$ is a linear, branched or cyclic alkyl group or an aryl group or an oxyalkyl group containing 1 to 8 carbon atoms, $C_{1-4}$ alkyl or phenyl groups being preferred, and [Z] is a linear polyhydroxyalkyl group, of which the alkyl chain is substituted by at least two hydroxyl groups, or alkoxylated, preferably ethoxylated or propoxylated, derivatives of that group.

[Z] is preferably obtained by reductive amination of a reduced sugar, for example glucose, fructose, maltose, lactose, galactose, mannose or xylose. The N-alkoxy- or N-aryloxy-substituted compounds may then be converted into the required polyhydroxyfatty acid amides by reaction with fatty acid methyl esters in the presence of an alkoxide as catalyst, for example in accordance with the teaching of International patent application WO-A-95/07331.

Since the alkaline component is intended to neutralize the anionic surfactant acid, but differs considerably therefrom in regard to molecular weight, clear differences in the quantities of foam exist where the pure foams, i.e. the foams containing only the particular active substance (anionic surfactant acid or alkali component), are used so that a relatively large quantity of anionic surfactant acid foam is combined with a relatively small quantity of alkali foam. Although homogeneous, rapid and complete neutralization with no risk of overheating or discoloration is possible by foaming both components, the quantities, i.e. volumes, of anionic surfactant acid and alkali foam can be adapted to one another in order to obtain further optimized process results. This can be done, for example, through the quantity of gaseous medium. Thus, a relatively large quantity of gaseous medium, based on the liquid, can be "foamed in" for foaming the alkali component which leads to an increase in the volume of foam. Another way is to incorporate alkali-stable detergent ingredients in the solution of the alkaline component, nonionic surfactants being particularly suitable because they also have a foam-stabilizing effect. If relatively large quantities of nonionic surfactants, based on the liquid to be foamed, are added to the alkali component in this way before foaming, the foam volumes of the two foams to be combined adapt themselves to one another which leads to optimized process results.

Irrespective of whether the pure anionic surfactant acid, a mixture of anionic surfactant acid and other detergent ingredients, the pure aqueous alkali solution or an aqueous alkali solution containing nonionic surfactant, for example, is foamed, the gaseous medium is used in quantities of at least 20% by volume, based on the amount of liquid to be foamed, for generating foam from the anionic surfactant in its acid form and the highly concentrated aqueous alkaline component.

Accordingly, if, for example, one liter of a highly concentrated ABS acid is to be foamed, at least 200 ml of gaseous medium is preferably used for foaming. In preferred processes, the quantity of gaseous medium is well above that value so that preferred processes are characterized in that the amount of gas used for foaming makes up one to three hundred times, preferably five to two hundred times and more preferably ten to one hundred times the volume of liquid to be foamed. As mentioned in the foregoing, air is preferably used as the gaseous medium. However, other gases or gas mixtures may be used for foaming. For example, pure oxygen or the air to be used for foaming may advantageously be passed through an ozonizer before the gas is used for foam generation. Gas mixtures containing, for example, 0.1 to 4% by weight of ozone may be prepared in this way. The ozone content of the foaming gas then leads to the oxidative destruction of unwanted constituents in the liquids to be foamed. In the case of partly discolored anionic surfactant acids in particular, a distinct lightening effect can be obtained by adding ozone.

Accordingly, 1 to 300 liters, preferably 5 to 200 liters and more preferably 10 to 100 liters of air are preferably used for foaming the liter of ABS acid mentioned by way of example in the foregoing.

The liquids to be foamed in the individual steps may be at room temperature before foaming, although foaming may also be carried out at elevated temperature. Preferred processes are characterized in that the liquid components to be foamed have temperatures before foaming of 20 to 100° C., preferably in the range from 30 to 90° C. and more preferably in the range from 50 to 75° C.

The two foams produced in the individual steps are then combined. A stable neutralizate foam is formed with partial release of the previously trapped gas providing the volumetric gas flow rate is very much larger than the flow of liquid (continuous process). This excess of gas supports the transport of the foam, dissipation of the heat of reaction generated and the discharge of excess water which comes from raw materials and the neutralization reaction. Overly elevated temperatures lead to unwanted brown discoloration of the neutralizate foam which should be avoided. Accordingly, in preferred variants of the process according to the invention, the neutralizate foam has temperatures below 115° C., preferably between 50 and 95° C. and more preferably between 70 and 90° C.

The neutralizate foam formed, which is used as a granulation aid in the next step of the process, can be characterized by other physical parameters. For example, the neutralizate foam preferably has a density of at most 0.80 $gcm^{-3}$, preferably in the range from 0.10 to 0.60 $gcm^{-3}$ and more preferably in the range from 0.30 to 0.55 $gcm^{-3}$. In another preferred embodiment, the neutralizate foam has mean pore sizes below 10 mm, preferably below 5 mm and more preferably below 2 mm. The mean pore size is calculated from the sum total of all pore sizes (pore diameters) which is divided by the number of pores and may be determined, for example, by photographic methods.

The above-mentioned physical parameters of temperature, density and mean pore size characterize the neutralizate foam at the time it is formed. However, the process is preferably controlled in such a way that the neutralizate foam satisfies the above-mentioned criteria even at the time it is introduced into the mixer.

Process control strategies in which the foam satisfies only one or two of the criteria mentioned when introduced into the mixer are possible, although both the temperature and the density and pore size preferably lie within the ranges mentioned when the foam enters the mixer.

After its formation, the neutralizate foam is applied to a bed of solids initially introduced into a mixer where it serves as a granulation aid. This step of the process may be carried out in various mixers and granulators. In one suitable mixer and granulator, for example an Eirich mixer, a Lödige mixer, for example a Lödige plowshare mixer, or a Schugi mixer, a solid bed is initially introduced at peripheral speeds of the mixing tools of, preferably, 2 to 7 m/s (plowshare mixer) or 3 to 50 m/s (Eirich, Schugi), more particularly between 5 and 20 m/s, and subsequently granulated in the presence of the neutralizate foam. At the same time, a predetermined particle size of the granules may be established in known manner. The granulation and mixing process takes only a very short time, for example about 0.5 to 10 minutes and, more particularly, about 0.5 to 5 minutes (Eirich mixer, L ödige mixer), to homogenize the mixture to form the flowable granules. By contrast, in a Schugi mixer, a residence time of 0.5 to 10 seconds is normally sufficient to obtain flowable granules. Mixers suitable for carrying out this step of the process are, for example, Series R or RV Eirich® mixers (trademarks of Maschinenfabrik Gustav Eirich, Hardheim), the Schugi® Flexomix, Fukae® FS-G mixers (trademarks of Fukae Powtech, Kogyo Co., Japan), Lödige® FM, KM and CB mixers (trademarks of Lödige Maschinenbau GmbH, Paderborn) and Series T or K-T Drais® mixers (trademarks of Drais-Werke GmbH, Mannheim).

The solid bed introduced into the mixer may contain all the substances used in detergents. In this way, ready-to-use detergents can be produced by the process according to the invention. Normally, however, certain detergent ingredients are not included in the granulation process in order to prevent these ingredients from entering into unwanted reactions with one another under the mechanical influence of the granulating tools. Ingredients which are normally added to the surfactant granules in a subsequent step, i.e. after the granulation process, include, for example bleaching agents, bleach activators, foam inhibitors and enzymes.

Besides the surfactant, the surfactant granules produced in accordance with the invention preferably contain substances which function as active substances in the final detergent. In preferred processes, therefore, the bed of solids introduced into the mixer contains one or more substances from the group of builders, more especially alkali metal carbonates, sulfates and silicates, zeolites and polymers.

Besides the detersive substances, builders are the most important ingredients of detergents. In the process according to the invention, any of the builders typically used in detergents may be present in the solid bed, i.e. in particular zeolites, silicates, carbonates, organic co-builders and—providing there are no ecological objections to their use—also phosphates.

Suitable crystalline layer-form sodium silicates correspond to the general formula $Na_2MSi_xO_{2x+1}$. $H_2O$, where M is sodium or hydrogen, x is a number of 1.9 to 4 and y is a number of 0 to 20, preferred values for x being 2, 3 or 4. Crystalline layer silicates such as these are described, for example, in European patent application EP-A-0 164 514. Preferred crystalline layer silicates corresponding to the above formula are those in which M is sodium and x assumes the value 2 or 3. Both β- and δ-sodium disilicates $Na_2Si_2O_5$. y $H_2O$ are particularly preferred, β-sodium disilicate being obtainable, for example, by the process described in International patent application WO-A-91/08171.

Other useful builders are amorphous sodium silicates with a modulus ($Na_2O$:$SiO_2$ ratio) of 1:2 to 1:3.3, preferably 1:2 to 1:2.8 and more preferably 1:2 to 1:2.6 which dissolve with delay and exhibit multiple wash cycle properties. The delay in dissolution in relation to conventional amorphous sodium silicates can have been obtained in various ways, for example by surface treatment, compounding, compacting or by overdrying. In the context of the invention, the term "amorphous" is also understood to encompass "X-ray amorphous". In other words, the silicates do not produce any of the sharp X-ray reflexes typical of crystalline substances in X-ray diffraction experiments, but at best one or more maxima of the scattered X-radiation which have a width of several degrees of the diffraction angle. However, particularly good builder properties may even be achieved where the silicate particles produce crooked or even sharp diffraction maxima in electron diffraction experiments. This may be interpreted to mean that the products have microcrystalline regions between 10 and a few hundred nm in size, values of up to at most 50 nm and, more particularly, up to at most 20 nm being preferred. So-called X-ray amorphous silicates such as these, which also dissolve with delay in relation to conventional waterglasses, are described for example in German patent application DE-A-44 00 024. Compacted amorphous silicates, compounded amorphous silicates and overdried X-ray-amorphous silicates are particularly preferred.

The finely crystalline, synthetic zeolite containing combined water used in accordance with the invention is preferably zeolite A and/or zeolite P. Zeolite MAP® (Crosfield) is a particularly preferred P-type zeolite. However, zeolite X and mixtures of A, X and/or P are also suitable. According to the invention, it is also possible to use, for example, a commercially obtainable co-crystallizate of zeolite X and zeolite A (ca. 80% by weight zeolite X) which is marketed by CONDEA Augusta S.p.A. under the name of VEGOGOND AX® and which may be described by the following formula:

$$n\mathrm{Na_2O}.(1\text{-}n)\mathrm{K_2O}.\mathrm{Al_2O_3}.(2\text{–}2.5)\mathrm{SiO_2}.(3.5\text{–}5.5)\mathrm{H_2O}$$

Suitable zeolites have a mean particle size of less than 10 $\mu$m (volume distribution, as measured by the Coulter Counter Method) and contain preferably 18 to 22% by weight and more preferably 20 to 22% by weight of bound water.

The generally known phosphates may of course also be used as builders providing their use should not be avoided on ecological grounds. The sodium salts of the orthophosphates, the pyrophosphates and, in particular, the tripolyphosphates are particularly suitable.

Useful organic builders are, for example, the polycarboxylic acids usable in the form of their sodium salts, such as citric acid, adipic acid, succinic acid, glutaric acid, tartaric acid, sugar acids, aminocarboxylic acids, nitrilotriacetic acid (NTA), providing there are no ecological objections to its use, and mixtures of these acids. Preferred salts are the salts of the polycarboxylic acids, such as citric acid, adipic acid, succinic acid, glutaric acid, tartaric acid, sugar acids and mixtures thereof.

Surfactant granules are foamed by the addition of the neutralizate foam in conjunction with the effect of the mixing tools. Processes according to the invention in which the neutralizate foam is added to the solid bed initially introduced into the mixer in a ratio by weight of foam to solid of 1:100 to 9:1, preferably 1:20 to 10:1 and more preferably 1:10 to 1:1 are preferred. Optimal granulation results are obtained with the preferred quantities of granulation aid (neutralizate foam).

The process according to the invention is variable over a broad range in regard to the choice of the ingredients to be used and their concentrations. Nevertheless, it is preferred in accordance with the invention to produce surfactant granules which have surfactant contents above 10% by weight, preferably above 15% by weight and more preferably above 20% by weight, based on the granules, and bulk densities above 600 g/l, preferably above 700 g/l and more preferably above 800 g/l.

The granulation process according to the invention may be carried out in such a way that particles with a predetermined size distribution are obtained. Processes according to the invention in which the surfactant granules have a particle size distribution where at least 50% by weight, preferably at least 60% by weight and more preferably at least 70% by weight of the particles are between 400 and 1600 $\mu$m in size are preferred.

The surfactant granules produced by the process according to the invention may be subsequently mixed with other detergent ingredients to form the end product. However, these ingredients may optionally be directly incorporated in the surfactant granules through the solid bed or through the neutralizate foam and are described hereinafter:

Besides the components mentioned (surfactant and builders), typical detergent ingredients from the group of bleaching agents, bleach activators, enzymes, pH regulators, perfumes, perfume carriers, fluorescers, dyes, foam inhibitors, silicone oils, redeposition inhibitors, optical brighteners, discoloration inhibitors, dye transfer inhibitors and corrosion inhibitors are particularly important.

Among the compounds yielding $H_2O_2$ in water which serve as bleaching agents, sodium perborate tetrahydrate and sodium perborate monohydrate are particularly important. Other useful bleaching agents are, for example, sodium percarbonate, peroxypyrophosphates, citrate perhydrates and $H_2O_2$-yielding peracidic salts or peracids, such as perbenzoates, peroxophthalates, diperazelaic acid, phthaloiminoperacid or diperdodecane dioic acid. Typical organic bleaching agents are diacyl peroxides, such as dibenzoyl peroxide for example. Other typical organic bleaching agents are the peroxy acids, of which alkyl peroxy acids and aryl peroxy acids are particularly mentioned as examples. Preferred representatives are (a) peroxybenzoic acid and ring-substituted derivatives thereof, such as alkyl peroxybenzoic acids, but also peroxy-$\alpha$-naphthoic acid and magnesium monoperphthalate, (b) aliphatic or substituted aliphatic peroxy acids, such as peroxylauric acid, peroxystearic acid, $\epsilon$-phthalimidoperoxycaproic acid [phthaloiminoperoxyhexanoic acid (PAP)], o-carboxybenzamidoperoxycaproic acid, N-nonenylamidoperadipic acid and N-nonenylamidopersuccinates. and (c) aliphatic and araliphatic peroxydicarboxylic acids, such as 1,12-diperoxycarboxylic acid, 1,9-diperoxyazelaic acid, diperoxysebacic acid, diperoxybrassylic acid, diperoxyphthalic acids, 2-decyldiperoxybutane-1,4-dioic acid, N,N-terephthaloyl-di(6-aminopercaproic acid).

Other suitable bleaching agents in machine dishwashing compositions are chlorine- and bromine-releasing substances. Suitable chlorine- or bromine-releasing materials are, for example, heterocyclic N-bromamides and N-chloramides, for example trichloroisocyanuric acid, tribromoisocyanuric acid, dibromoisocyanuric acid and/or dichloroisocyanuric acid (DICA) and/or salts thereof with cations, such as potassium and sodium. Hydantoin compounds, such as 1,3-dichloro-5,5-dimethyl hydantoin, are also suitable.

In order to obtain an improved bleaching effect where washing is carried out at temperatures of 60° C. or lower, bleach activators may be incorporated in the surfactant mixtures according to the invention. The bleach activators may be compounds which form aliphatic peroxocarboxylic acids containing preferably 1 to 10 carbon atoms and more preferably 2 to 4 carbon atoms and/or optionally substituted perbenzoic acid under perhydrolysis conditions. Substances bearing O- and/or N-acyl groups with the number of carbon atoms mentioned and/or optionally substituted benzoyl groups are suitable. Preferred bleach activators are polyacylated alkylenediamines, more particularly tetraacetyl ethylenediamine (TAED), acylated triazine derivatives, more particularly 1,5-diacetyl-2,4-dioxohexa-hydro-1,3,5-triazine (DADHT), acylated glycolurils, more particularly tetraacetyl glycoluril (TAGU), N-acylimides, more particularly N-nonanoyl succinimide (NOSI), acylated phenol sulfonates, more particularly n-nonanoyl or isononanoyloxybenzenesulfonate (n- or iso-NOBS), carboxylic anhydrides, more particularly phthalic anhydride, acylated polyhydric alcohols, more particularly triacetin, ethylene glycol diacetate and 2,5-diacetoxy-2,5-dihydrofuran.

In addition to or instead of the conventional bleach activators mentioned above, so-called bleach catalysts may also be incorporated in the surfactant mixtures according to the invention. Bleach catalysts are bleach-boosting transition metal salts or transition metal complexes such as, for example, manganese-, iron-, cobalt-, ruthenium- or molybdenum-salen complexes or carbonyl complexes. Manganese, iron, cobalt, ruthenium, molybdenum, titanium, vanadium and copper complexes with nitrogen-containing tripod ligands and cobalt-, iron-, copper- and ruthenium-amine complexes may also be used as bleach catalysts.

Suitable enzymes are those from the class of proteases, lipases, amylases, cellulases or mixtures thereof. Enzymes obtained from bacterial strains or fungi, such as *Bacillus subtilis, Bacillus licheniformis* and *Streptomyces griseus,* are particularly suitable. Proteases of the subtilisin type are preferred, proteases obtained from *Bacillus lentus* being particularly preferred. Enzyme mixtures, for example of protease and amylase or protease and lipase or protease and cellulase or of cellulase and lipase or of protease, amylase and lipase or of protease, lipase and cellulase, but especially cellulase-containing mixtures, are of particular interest. Peroxidases or oxidases have also proved to be suitable in some cases. The enzymes may be adsorbed to supports and/or encapsulated in shell-forming substances to protect them against premature decomposition.

In addition, the detergents according to the invention may also contain components with a positive effect on the removability of oil and fats from textiles by washing (so-called soil repellents). This effect becomes particularly clear when a textile which has already been repeatedly washed with a detergent according to the invention containing this oil- and fat-dissolving component is soiled. Preferred oil- and fat-dissolving components include, for example, nonionic cellulose ethers, such as methyl cellulose and methyl hydroxypropyl cellulose containing 15 to 30% by weight of methoxyl groups and 1 to 15% by weight of hydroxypropoxyl groups, based on the nonionic cellulose ether, and the polymers of phthalic acid and/or terephthalic acid known from the prior art or derivatives thereof, more particularly polymers of ethylene terephthalates and/or polyethylene glycol terephthalates or anionically and/or nonionically modified derivatives thereof. Of these, the sulfonated derivatives of phthalic acid and terephthalic acid polymers are particularly preferred.

The detergents may contain derivatives of diaminostilbenedisulfonic acid or alkali metal salts thereof as optical brighteners. Suitable optical brighteners are, for example, salts of 4,4'-bis-(2-anilino-4-morpholino-1,3,5-triazinyl-6-amino)-stilbene-2,2'-disulfonic acid or compounds of similar composition which contain a diethanolamino group, a methylamino group, an anilino group or a 2-methoxyethylamino group instead of the morpholino group. Brighteners of the substituted diphenyl styryl type, for example alkali metal salts of 4,4'-bis-(2-sulfostyryl)-diphenyl, 4,4'-bis-(4-chloro-3-sulfostyryl)-diphenyl or 4-(4-chlorostyryl)4'-(2-sulfostyryl)-diphenyl, may also be present. Mixtures of the brighteners mentioned above may also be used.

Dyes and perfumes are added to the detergents according to the invention to improve the aesthetic impression created by the products and to provide the consumer not only with the required washing performance but also with a visually and sensorially "typical and unmistakable" product. Suitable perfume oils or perfumes include individual perfume compounds, for example synthetic products of the ester, ether, aldehyde, ketone, alcohol and hydrocarbon type. Perfume compounds of the ester type are, for example, benzyl acetate, phenoxyethyl isobutyrate, p-tert.butyl cyclohexyl acetate, linalyl acetate, dimethyl benzyl carbinyl acetate, phenyl ethyl acetate, linalyl benzoate, benzyl formate, ethyl methyl phenyl glycinate, allyl cyclohexyl propionate, styrallyl propionate and benzyl salicylate. The ethers include, for example, benzyl ethyl ether; the aldehydes include, for example, the linear alkanals containing 8 to 18 carbon atoms, citral, citronellal, citronellyloxyacetaldehyde, cyclamen aldehyde, hydroxycitronellal, lilial and bourgeonal; the ketones include, for example, the ionones, α-isomethyl ionone and methyl cedryl ketone; the alcohols include anethol, citronellol, eugenol, geraniol, linalool, phenyl ethyl alcohol and terpineol and the hydrocarbons include, above all, the terpenes, such as limonene and pinene. However, mixtures of various perfumes which together produce an attractive perfume note are preferably used. Perfume oils such as these may also contain natural perfume mixtures obtainable from vegetable sources, for example pine, citrus, jasmine, patchouli, rose or ylang-ylang oil. Also suitable are clary oil, camomile oil, nettle oil, melissa oil, mint oil, cinnamon leaf oil, lime blossom oil, juniper berry oil, vetiver oil, olibanum oil, galbanum oil and labdanum oil and orange blossom oil, neroli oil, orange peel oil and sandalwood oil.

The dye content of detergents is normally below 0.01% by weight whereas perfumes can make up as much as 2% by weight of the formulation as a whole.

The perfumes may be directly incorporated in the detergents, although it can also be of advantage to apply the perfumes to carriers which strengthen the adhesion of the perfume to the laundry and which provide the fabrics with a long-lasting fragrance through the slower release of perfume. Cyclodextrins, for example, have proved to be suitable carriers. In addition, the cyclodextrin/perfume complexes may be coated with other auxiliaries.

In order to improve their aesthetic impression, detergents may be colored with suitable dyes. Preferred dyes, which are not difficult for the expert to select, are characterized by high storage stability and stability to the other ingredients of the detergents and to light and by no pronounced substantivity towards textile fibers so as not to color them.

The neutralizate foam produced in the process according to the invention and its use as a granulation aid have never been described in the prior-art literature. Accordingly, the present invention also relates to a neutralizate foam obtainable by combining an anionic surfactant in its acid form foamed with a gaseous medium and a highly concentrated aqueous alkaline component foamed with a gaseous medium, characterized in that the foam has mean pore sizes below 10 mm, preferably below 5 mm and more preferably below 2 mm.

As already emphasized in the description of the process according to the invention, a neutralizate foam in which the gaseous medium makes up at least 20% by volume, based on the foamed volume of liquid is preferred. In one particularly preferred neutralizate foam, the gaseous medium makes up between one and three hundred times, preferably between five and two hundred times and more preferably between ten and one hundred times the volume of foamed liquid.

So far as the ingredients of the foams produced in separate steps are concerned, reference is again made to the description of preferred embodiments of the process according to the invention. Preferred neutralizate foams are obtained by combining a foam of an anionic surfactant in its acid form, which optionally contains other, preferably acidic, detergent ingredients, and a foam of an aqueous alkali metal hydroxide, preferably sodium hydroxide, solution optionally containing other detergent ingredients, more particularly nonionic surfactants. The neutralizate foam was preferably obtained by combining an anionic surfactant acid foam and a sodium hydroxide foam containing nonionic surfactant, the sodium hydroxide foam containing 5 to 80% by weight, preferably 10 to 75% by weight and more preferably 25 to 70% by weight of nonionic surfactant, based on the weight of the sodium hydroxide foam. Another preferred neutralizate foam is obtained by combining a foam of an anionic surfactant in its acid form, which contains nonionic surfactants in quantities of 0.1 to 10% by weight, preferably 0.5 to 7.5% by weight and more preferably 1 to 5% by weight, based on the weight of the anionic surfactant acid foam, and a foam of an aqueous alkali metal hydroxide, preferably sodium hydroxide, solution optionally containing other detergent ingredients, more particularly nonionic surfactants.

The neutralizate foam according to the invention preferably has a high surfactant content. Neutralizate foams with surfactant contents of 20 to 99% by weight, preferably 60 to 95% by weight and more preferably 70 to 90% by weight, based on the weight of the foam, are preferred.

The present invention also relates to the use of the neutralizate foams according to the invention as granulation aids in the production of surfactant granules. So far as the quantity ratios between granulation aid (neutralizate foam) and solid bed, the mixer to be used and the ingredients suitable for use in the solid bed are concerned, reference is made to the foregoing observations.

EXAMPLES a) Continuous Process

The following liquid streams were fed through two separate pipe sections equipped with nonreturn valves:

Liquid Component I 103.7 kg/h $C_{9-13}$ alkyl benzenesulfonic acid 10.6 kg/h $C_{12-18}$ fatty acid 4.2 kg/h hydroxyethane-1,1-diphosphonic acid Liquid Component II 61.7 kg/h $C_{12-18}$ fatty alcohol+7 EO 33.9 kg/h sodium hydroxide solution, 50%

Before foaming, liquid component I had a temperature of 74° C. and liquid component II a temperature of 61° C. The liquid streams were each foamed with 8 $m^3$/h air using sintered disks and the foams formed were combined in a static mixer. Complete mixing of the two foams to give the neutralizate foam was carried out in a dynamic mixer with an internal capacity of 5 liters (type RM 3-30/65, manufacturer: GTA, D-31699 Beckerdorf), so that the residence time was a matter of seconds. The stable neutralizate foam formed had the following physical parameters on leaving the dynamic mixer:

| | |
|---|---|
| temperature | 80° C. |
| density | 0.45 $gcm^{-3}$ |
| pore size | <2 mm. |

The neutralizate foam (temperature 80° C.) was introduced through a 20 mm pipe into a plowshare mixer with two cutter heads (type KM300-D, manufacturer: Gebrüder L ödige, Paderborn), the foam impinging on the moving bed of solids in the region of the first cutter head.

The following streams were processed as the solid bed:

288.6 kg/h zeolite A (Wessalith® P, Degussa)

256.2 kg/h sodium sulfate 169.6 kg/h sodium carbonate 85.9 kg/h Sokalan® CP 5, 50%*

* acrylic acid/maleic acid copolymer (BASF) on a support (sodium sulfate/sodium carbonate 1:1).

The granules continuously discharged from the mixer had the following physical parameters:

| | | |
|---|---|---|
| bulk density | | 840 g/l |
| sieve analysis | >1.6 mm | 3% by weight |
| | >1.2 mm | 9% by weight |
| | >0.8 mm | 26% by weight |
| | >0.4 mm | 41% by weight |
| | <0.4 mm | 22% by weight |
| color | | pure white. |

For comparison, the process according to the invention as described above was varied to the extent that the liquids were not foamed before mixing (no air introduced). In this Comparison Example, the temperature in the dynamic mixer rose beyond 110° C. and the neutralizate paste turned brown in color. Introduction into the mixer produced tacky granules with a high proportion of oversize granules.

b) Batch Process

Using a glass frit, liquid components I and II heated to 70° C. (composition as indicated below, figures based on the mixture as a whole) were foamed to twice their volume with air as the gaseous medium.

Liquid Component I 10.37% by weight $C_{9-13}$ alkyl benzenesulfonic acid 1.06% by weight $C_{12-18}$ fatty acid 6.71% by weight $C_{12-18}$ fatty alcohol+7 EO 0.42% by weight hydroxyethane-1,1-diphosphonic acid Liquid Component II 2.53% by weight sodium hydroxide solution, 65%

The foamed liquid components I and II were mixed with a laboratory stirrer and the neutralizate foam was re-foamed to twice its volume. The neutralizate foam was then introduced into a 50 liter Lödige mixer plus chopping unit accommodating the bed of solids (for composition, see below), a total batch of 10 kg being processed.

Solid bed:

30.88% by weight zeolite A (Wessalith® P, Degussa)

32.93% by weight sodium sulfate 6.51% by weight sodium carbonate 8.59% by weight Sokalan® CP 5, 50%*

* acrylic acid/maleic acid copolymer (BASF) on a support (sodium sulfate/sodium carbonate 1:1).

The granules continuously discharged from the mixer had the following physical parameters:

| | | |
|---|---|---|
| bulk density | | 835 g/l |
| sieve analysis | >1.6 mm | 13% by weight |
| | >0.8 mm | 22% by weight |
| | >0.4 mm | 33% by weight |
| | >0.2 mm | 24% by weight |
| | >0.1 mm | 7% by weight |
| | <0.1 mm | 1% by weight |
| color | | pure white. |

Further experiments on a production scale were carried out with liquid components having the composition shown in Table 1. To this end, liquid components I and II were each introduced at 50° C. into a pipe section equipped with a nonreturn valve and, using sintered disks, were foamed with 50 times the volume of compressed air. The foams formed were combined in a static mixer and homogeneously mixed in a dynamic mixer to form a neutralizate foam [density 0.5 $gcm^{-3}$, pore size<1 mm, temperature ca. 80° C. (neutralization reaction)].

The neutralizate foam was introduced into a plowshare mixer with two cutter heads (type KM300-D, manufacturer: Gebrüder Lödige, Paderborn), the foam impinging on the moving bed of solids (for composition, see Table 2) in the region of the first cutter head and the mixing tools being moved at peripheral speeds of 3 m/s. The continuous granulation process was carried out with an output of 1 to 1.4 t/h. Pure white free-flowing surfactant granules were again obtained. Their composition is shown in Table 3 and their physical properties are set out in Table 4. Surfactant granules E2 were fed to a Lihotzky twin-screw extruder and extruded through multiple-bore extrusion dies with bore diameters of 1.8 mm under a pressure of 25 bar and at a temperature of 54° C. After extrusion, the strand sections obtained were rounded in a commercially available spheronizer, zeolite A (3.5% by weight) being used for powdering. The data in Table 4 relate to the crude extrudate for Example E2. Example E2 also shows that so-called minor components (in this case optical brightener) can be incorporated in the products through the foams.

TABLE 1

| Composition of the flowable surfactant components [% by weight] | E1 | E2 | E3 | E4 | E5 |
|---|---|---|---|---|---|
| a) Liquid component I | | | | | |
| $C_{9-13}$ alky benzene sulfonic acid | 87.5 | 87.7 | 87.5 | 87.5 | 87.5 |
| $C_{12-18}$ fatty acid | 9.0 | 4.8 | 9.0 | 9.0 | 9.0 |
| Hydroxyethane-1,1-diphosphonic acid | 3.5 | 7.5 | 3.5 | 3.5 | 3.5 |
| b) Liquid component II | | | | | |
| Sodium hydroxide, 50% | 33.5 | 47.0 | 33.5 | 99.5 | — |
| Potassium hydroxide, 50% | — | — | — | — | 41.5 |
| Carboxymethyl cellulose | — | — | — | 0.5 | — |
| $C_{12-18}$ fatty alcohol + 7 EO | 66.5 | 25.8 | 66.5 | — | 58.5 |
| Polyethylene glycol 400 | — | 25.8 | — | — | — |
| Optical brightener | — | 1.4 | — | — | — |

TABLE 2

| Composition of the solid bed [% by weight] | E1 | E2 | E3 | E4 | E5 |
|---|---|---|---|---|---|
| Zeolite A (Wessalith ® P, Degussa) | 34.5 | 5.1*** | 37.0 | 34.5 | — |
| Zeolite X (Wessalith ® XD, Degussa) | — | 56.1 | — | — | 36.5 |
| Sodium sulfate | 32.8 | — | 28.0 | 33.0 | 44.0 |
| Sodium carbonate | 21.5 | — | 23.5 | 29.0 | 8.5 |
| Sodium citrate | — | 6.2 | — | — | — |
| Polyethylene glygol 4000 | — | 3.1 | — | — | — |
| Polymer compound* | 11.2 | 17.1 | 11.5 | 3.5 | 11.0 |
| Fatty alcohol sulfate compound** | — | 12.4 | — | — | — |

*Composition:
50% by weight acrylic acid/maleic acid copolymer (Sokalan ® CP5, BASF)

TABLE 2-continued

| Composition of the solid bed [% by weight] | E1 | E2 | E3 | E4 | E5 |
|---|---|---|---|---|---|
| 36% by weight sodium carbonate | | | | | |
| 10% by weight sodium sulfate | | | | | |
| 4% by weight salts, water | | | | | |
| **Composition: | | | | | |
| 92% by weight $C_{12-18}$ fatty alcohol sulfate | | | | | |
| 3% by weight sodium carbonate | | | | | |
| 5% by weight salts, water | | | | | |
| ***After extrusion in the spheronizer | | | | | |

TABLE 3

| Composition of the surfactant granules [% by weight] | E1 | E2 | E3 | E4 | E5 |
|---|---|---|---|---|---|
| Liquid component I (Table 1a) | 11.85 | 18.55 | 11.85 | 23.17 | 11.85 |
| Liquid component II (Table 1b) | 10.10 | 12.27 | 10.10 | 6.65 | 11.47 |
| = Neutralizate foam (Table 1) | 21.95 | 30.82 | 21.95 | 29.82 | 23.32 |
| Solids (Table 2) | 78.05 | 69.18 | 78.05 | 70.18 | 76.68 |

TABLE 4

| Physical data of the surfactant granules | E1 | E2 | E3 | E4 | E5 |
|---|---|---|---|---|---|
| Bulk density [g/l] | 850 | 750 | 916 | 828 | 980 |
| Sieve analysis [% by weight] | | | | | |
| >1.6 mm | 7 | 90 | 2 | 2 | 0 |
| >1.2 mm | 13 | 9 | 4 | 4 | 1 |
| >0.8 mm | 23 | 1 | 14 | 15 | 5 |
| >0.4 mm | 26 | — | 52 | 27 | 26 |
| <0.4 mm | 31 | — | 28 | 44 | 68 |
| Color | Pure white | Radiant white | Pure white | Pure white | Pure white |

What is claimed is:

1. A process for the production of surfactant granules, comprising the steps of foaming a liquid comprising one or more anionic surfactants in acid form with a gas to form an acidic foam, separately foaming an aqueous alkaline component with a gaseous medium to form an alkaline foam, combining the acidic and alkaline foams to form a neutralizate foam, applying the neutralizate foam to a bed of solids, and forming the surfactant granules from the solids.

2. The process of claim 1, wherein the one or more anionic surfactants in acid form are selected from the group consisting of carboxylic acids, sulfuric acid semiesters, and sulfonic acids.

3. The process of claim 2, wherein the one or more anionic surfactants in acid form are selected from the group consisting of fatty acids, fatty alkyl sulfuric acids, and alkylaryl sulfonic acids.

4. The process of claim 1, wherein the one or more anionic surfactants in acid form comprise one or more $C_{8-16}$ alkyl benzenesulfonic acids.

5. The process of claim 1, wherein the one or more anionic surfactants in acid form comprise one or more $C_{9-13}$ alkyl benzenesulfonic acids.

6. The process of claim 1, wherein the liquid comprising the one or more anionic surfactants in acid form comprises the one or more anionic surfactants and 0.1% to 40% by weight, based on the liquid weight, of one or more detergent ingredients.

7. The process of claim 6, wherein the liquid comprising the one or more anionic surfactants in acid form comprises the one or more anionic surfactants and 1% to 15% by weight, based on the liquid weight, of one or more detergent ingredients.

8. The process of claim 7, wherein the liquid comprising the one or more anionic surfactants in acid form comprises the one or more anionic surfactants and 2% to 10% by weight, based on the liquid weight, of one or more detergent ingredients.

9. The process of claim 6, wherein the one or more detergent ingredients comprise acidic detergent ingredients.

10. The process of claim 1, wherein the liquid comprising the one or more anionic surfactants in acid form comprises the one or more anionic surfactants and 0.1% to 40% by weight, based on the liquid weight, of one or more nonionic surfactants.

11. The process of claim 10, wherein the liquid comprising the one or more anionic surfactants in acid form comprises the one or more anionic surfactants and 1% to 15% by weight, based on the liquid weight, of one or more nonionic surfactants.

12. The process of claim 11, wherein the liquid comprising the one or more anionic surfactants in acid form comprises the one or more anionic surfactants and 2% to 10% by weight, based on the liquid weight, of one or more nonionic surfactants.

13. The process of claim 1, wherein the aqueous alkaline component comprises an alkali metal hydroxide solution.

14. The process of claim 13, wherein the aqueous alkaline component comprises a sodium hydroxide solution.

15. The process of claim 13, wherein the aqueous alkaline component comprises at least 40% by weight NaOH.

16. The process of claim 15, wherein the aqueous alkaline component comprises at least 50% by weight NaOH.

17. The process of claim 16, wherein the aqueous alkaline component comprises at least 65% by weight NaOH.

18. The process of claim 1, wherein the aqueous alkaline component comprises 0.1% to 80% by weight of other detergent ingredients.

19. The process of claim 18, wherein the aqueous alkaline component comprises 10% to 75% by weight of other detergent ingredients.

20. The process of claim 19, wherein the aqueous alkaline component comprises 25% to 70% by weight of other detergent ingredients.

21. The process of claim 1, wherein the aqueous alkaline component further comprises one or more surfactants.

22. The process of claim 21, wherein the surfactants of the aqueous alkaline component comprise one or more anionic or nonionic surfactants.

23. The process of claim 21, wherein the surfactants of the aqueous alkaline component comprise one or more ethoxylated alcohols or soaps.

24. The process of claim 1, wherein the volume of the gas used to form the acidic and alkaline foams is at least 20% of the volume of the liquid and the aqueous alkaline component to be foamed.

25. The process of claim 24, wherein the volume of the gas used to form the acidic and alkaline foams is one to three hundred times the volume of the liquid and the aqueous alkaline component to be foamed.

26. The process of claim 25, wherein the volume of the gas used to form the acidic and alkaline foams is five to two hundred times the volume of the liquid and the aqueous alkaline component to be foamed.

27. The process of claim 26, wherein the volume of the gas used to form the acidic and alkaline foams is ten to one hundred times the volume of the liquid and the aqueous alkaline component to be foamed.

28. The process of claim 1, wherein the gas for forming the acidic and alkaline foams comprises air.

29. The process of claim 1, wherein the liquid comprising the one or more anionic surfactants in acid form and the aqueous alkaline component have temperatures of 20° C. to 100° C. before being foamed.

30. The process of claim 29, wherein the liquid comprising the one or more anionic surfactants in acid form and the aqueous alkaline component have temperatures of 30° C. to 90° C. before being foamed.

31. The process of claim 30, wherein the liquid comprising the one or more anionic surfactants in acid form and the aqueous alkaline component have temperatures of 50° C. to 75° C. before being foamed.

32. The process of claim 1, wherein the neutralizate foam has a temperature below 115° C.

33. The process of claim 32, wherein the neutralizate foam has a temperature between 50° C. and 95° C.

34. The process of claim 33, wherein the neutralizate foam has a temperature between 65° C. and 90° C.

35. The process of claim 1, wherein the neutralizate foam has a density of at most 0.80 g/cm$^3$.

36. The process of claim 35, wherein the neutralizate foam has a density of from 0.10 g/cm$^3$ to 0.6 g/cm$^3$.

37. The process of claim 36, wherein the neutralizate foam has a density of from 0.3 g/cm$^3$ to 0.55 g/cm$^3$.

38. The process of claim 1, wherein the neutralizate foam has a mean pore size below 10 mm.

39. The process of claim 38, wherein the neutralizate foam has a mean pore size below 5 mm.

40. The process of claim 39, wherein the neutralizate foam has a mean pore size below 2 mm.

41. The process of claim 1, wherein the solids comprise one or more builders.

42. The process of claim 41, wherein the builders comprise one or more selected from the group consisting of carbonates, sulfates, silicates, zeolites and polymers.

43. The process of claim 1, wherein the neutralizate foam is applied to the solids in a ratio by weight of foam to solids of 1:100 to 9:1.

44. The process of claim 43, wherein the neutralizate foam is applied to the solids in a ratio by weight of foam to solids of 1:30 to 2:1.

45. The process of claim 44, wherein the neutralizate foam is applied to the solids in a ratio by weight of foam to solids of 1:20 to 1:1.

46. The process of claim 1, wherein the surfactant granules comprise above 10% by weight of surfactant and have a bulk density of above 600 g/l.

47. The process of claim 46, wherein the surfactant granules comprise above 15% by weight of surfactant and have a bulk density of above 700 g/l.

48. The process of claim 47, wherein the surfactant granules comprise above 20% by weight of surfactant and have a bulk density of above 800 g/l.

49. The process of claim 1, wherein the surfactant granules have a particle size distribution in which at least 50% by weight of the particles are between 400 and 1600 $\mu$m in size.

50. The process of claim 49, wherein the surfactant granules have a particle size distribution in which at least 60% by weight of the particles are between 400 and 1600 $\mu$m in size.

51. The process of claim 50, wherein the surfactant granules have a particle size distribution in which at least 70% by weight of the particles are between 400 and 1600 $\mu$m in size.

* * * * *